US008669974B2

(12) United States Patent
Yang et al.

(10) Patent No.: US 8,669,974 B2
(45) Date of Patent: Mar. 11, 2014

(54) FLAT DISPLAY AND TIMING CONTROLLER THEREOF FOR NEUTRALIZING CHARGES IN LIQUID CRYSTAL CAPACITORS UPON SHUT DOWN

(75) Inventors: Yu-Chu Yang, Tainan County (TW); Fa-Ming Chen, Tainan County (TW); Po-Hsien Tsai, Tainan County (TW); Mao-Hsiung Kuo, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 1398 days.

(21) Appl. No.: 11/808,828

(22) Filed: Jun. 13, 2007

(65) Prior Publication Data

US 2008/0062072 A1 Mar. 13, 2008

(30) Foreign Application Priority Data

Sep. 11, 2006 (TW) ..... 95133525 A

(51) Int. Cl.
*G09G 5/00* (2006.01)
*G09G 3/36* (2006.01)

(52) U.S. Cl.
USPC ..... 345/213; 345/212; 345/99; 345/100

(58) Field of Classification Search
USPC ..... 345/30, 32, 55, 84, 87–104, 204–215, 345/690–699; 349/47–90
See application file for complete search history.

(56) References Cited

U.S. PATENT DOCUMENTS

| | | | | |
|---|---|---|---|---|
| 5,248,963 | A * | 9/1993 | Yasui et al. | 345/98 |
| 5,751,278 | A * | 5/1998 | Inamori et al. | 345/211 |
| 5,793,346 | A * | 8/1998 | Moon | 345/92 |
| 7,499,009 | B2 * | 3/2009 | Kanbe et al. | 345/87 |
| 2001/0009411 | A1 * | 7/2001 | Kusanagi | 345/93 |
| 2002/0041279 | A1 * | 4/2002 | Chou | 345/211 |
| 2002/0105490 | A1 * | 8/2002 | Kanbe et al. | 345/87 |
| 2002/0158823 | A1 * | 10/2002 | Zavracky et al. | 345/87 |
| 2002/0196223 | A1 * | 12/2002 | Takahashi et al. | 345/90 |
| 2004/0189629 | A1 * | 9/2004 | Fukutoku | 345/211 |
| 2006/0007096 | A1 * | 1/2006 | Kawaguchi et al. | 345/102 |
| 2006/0012552 | A1 * | 1/2006 | Chiu et al. | 345/87 |
| 2006/0022932 | A1 * | 2/2006 | Sagawa et al. | 345/98 |
| 2008/0150860 | A1 * | 6/2008 | Hong | 345/87 |

* cited by examiner

*Primary Examiner* — Bipin Shalwala
*Assistant Examiner* — Keith Crawley
(74) *Attorney, Agent, or Firm* — Rabin & Berdo, P.C.

(57) ABSTRACT

A timing controller adapted to a flat display includes a voltage detecting circuit, a clock generator, a first multiplexer and a second multiplexer. The voltage detecting circuit detects a variation of an operating voltage and thus outputs a reset signal. The clock generator outputs a start signal and a first clock signal. The first multiplexer is controlled by the reset signal and coupled to the start signal and a constant voltage. The second multiplexer is controlled by the reset signal and coupled to the first clock signal and a second clock signal. A frequency of the second clock signal is obviously higher than a frequency of the first clock signal.

14 Claims, 4 Drawing Sheets

FLAT DISPLAY AND TIMING CONTROLLER THEREOF FOR NEUTRALIZING CHARGES IN LIQUID CRYSTAL CAPACITORS UPON SHUT DOWN

This application claims the benefit of Taiwan application Serial No. 95133525, filed Sep. 11, 2006, the subject matter of which is incorporated herein by reference.

BACKGROUND OF THE INVENTION

1. Field of the Invention

The invention relates in general to a flat display, and more particularly to a flat display and a timing controller thereof for eliminating a shutdown residual image of the flat display by way of timing control.

2. Description of the Related Art

A flat display, such as a liquid crystal display (LCD), has the advantages of the high image quality, the small size, the light weight, the low driving voltage and the low power consumption. So, the flat display has been widely applied to consumer communication or electronic products, such as personal digital assistants (PDAs), mobile telephones, video recorder/players, notebook computers, desktop displays, mobile displays and projection television, and gradually replaces the cathode ray tube (CRT) to become the mainstream of the display.

In the typical architecture of the LCD, a residual image is frequently seen on the LCD panel after the LCD is shut down, or even cannot disappear after several seconds have elapsed. This phenomenon cannot satisfy the visual exception of the user and decreases the display quality of the LCD panel after a long period of time has elapsed. Taking a thin film transistor (TFT) LCD as an example, one of the main reasons for causing the shutdown residual image is that the discharge speed of the pixel electrode in the TFT LCD is too slow so that the charges cannot be quickly released and are remained in the liquid crystal capacitor after shutdown. Thus, the charges cannot be completely discharged after a period of time has elapsed.

FIG. 1 (Prior Art) is a schematic illustration showing a conventional LCD 10. As shown in FIG. 1, a timing controller (not shown in FIG. 1) outputs data to a pixel array 16 in the LCD 10. The pixel array 16 receives and writes scan rows of data using a source driver, and selects the scan rows of the to-be-written data by using a gate driver 12 so that an output frame is displayed on the LCD panel. In order to eliminate the phenomenon of the shutdown residual image when the LCD is shut down, a reset circuit 14 detects the variation of an operating voltage VDD to output a voltage signal Sr to a scan-row-fully-open pin XAO of the gate driver 12 so that the gate driver 12 simultaneously turns on the thin film transistors in all the scan rows of the pixel array 16. Thus, the charges may be rapidly discharged according to the charge neutralization, the time for completely discharging the residual charges can be shortened, and the phenomenon of the shutdown residual image can be thus eliminated.

In the LCD 10 mentioned hereinabove, the reset circuit 14 has to be added to the LCD 10 and the scan-row-fully-open pin XAO has to be added to the gate driver 12 in order to decrease the influence of the residual image and to inform the gate driver 12 to turn on the thin film transistors in all the scan rows of the pixel array 16 when the LCD 10 is shut down. In the actual circuit implementation, however, adding the reset circuit 14 and the scan-row-fully-open pin XAO increases the number of the circuit components, the area of the printed circuit board and the package area, and thus the cost greatly increases.

SUMMARY OF THE INVENTION

The invention is directed to a flat display, and more particularly to a flat display and a timing controller thereof for eliminating a residual image of the flat display by way of timing control when the flat display is shut down.

According to a first aspect of the present invention, a timing controller adapted to a flat display is provided. The timing controller includes a voltage detecting circuit, a clock generator, a first multiplexer and a second multiplexer. The voltage detecting circuit detects a variation of an operating voltage and thus outputs a reset signal. The clock generator outputs a start signal and a first clock signal. The first multiplexer is controlled by the reset signal and coupled to the start signal and a constant voltage. The second multiplexer is controlled by the reset signal and coupled to the first clock signal and a second clock signal. The second clock signal has a frequency obviously higher than a frequency of the first clock signal. When the flat display operates normally, the voltage detecting circuit outputs the reset signal having a first level voltage according to the existence of the operating voltage to control the first multiplexer to output the start signal to a gate driver of the flat display, and to control the second multiplexer to output the first clock signal to the gate driver. When the flat display is shut down, the voltage detecting circuit outputs the reset signal having a second level voltage according to the variation of the operating voltage to control the first multiplexer to output the constant voltage to the gate driver, and to control the second multiplexer to output the second clock signal to the gate driver. The first level voltage and the second level voltage have opposite levels.

According to a second aspect of the present invention, a flat display is provided. The flat display includes a pixel array, a gate driver and a source driver. The invention is characterized in that the flat display further includes a voltage detecting circuit, a timing controller, a first multiplexer and a second multiplexer. The voltage detecting circuit detects a variation of an operating voltage and thus outputs a reset signal. The timing controller outputs a start signal and a first clock signal. The first multiplexer is controlled by the reset signal and coupled to the start signal and a constant voltage. The second multiplexer is controlled by the reset signal and coupled to the first clock signal and a second clock signal. The second clock signal has a frequency obviously higher than a frequency of the first clock signal. When the flat display operates normally, the voltage detecting circuit outputs the reset signal having a first level voltage according to the existence of the operating voltage to control the first multiplexer to output the start signal to the gate driver, and to control the second multiplexer to output the first clock signal to the gate driver. When the flat display is shut down, the voltage detecting circuit outputs the reset signal having a second level voltage according to the variation of the operating voltage to control the first multiplexer to output the constant voltage to the gate driver, and to control the second multiplexer to output the second clock signal to the gate driver. The first level voltage and the second level voltage have opposite levels.

The invention will become apparent from the following detailed description of the preferred but non-limiting embodiments. The following description is made with reference to the accompanying drawings.

DETAILED DESCRIPTION OF THE INVENTION

The invention provides a flat display and a timing controller thereof for eliminating a residual image of the flat display by way of timing control when the flat display is shut down. Thus, the thin film transistors in all scan rows of the pixel array can be quickly turned on to eliminate the residual image quickly without adding the reset circuit and the scan-row-fully-open pin XAO to the gate driver when the display is shut down. The flat display according to any embodiment of the invention will be described by taking, without limitation to, the liquid crystal display (LCD) as an example. It is to be specified that any flat display having the features of the invention is still deemed as falling within the spirit and the scope of the invention.

First Embodiment

Figure 1:
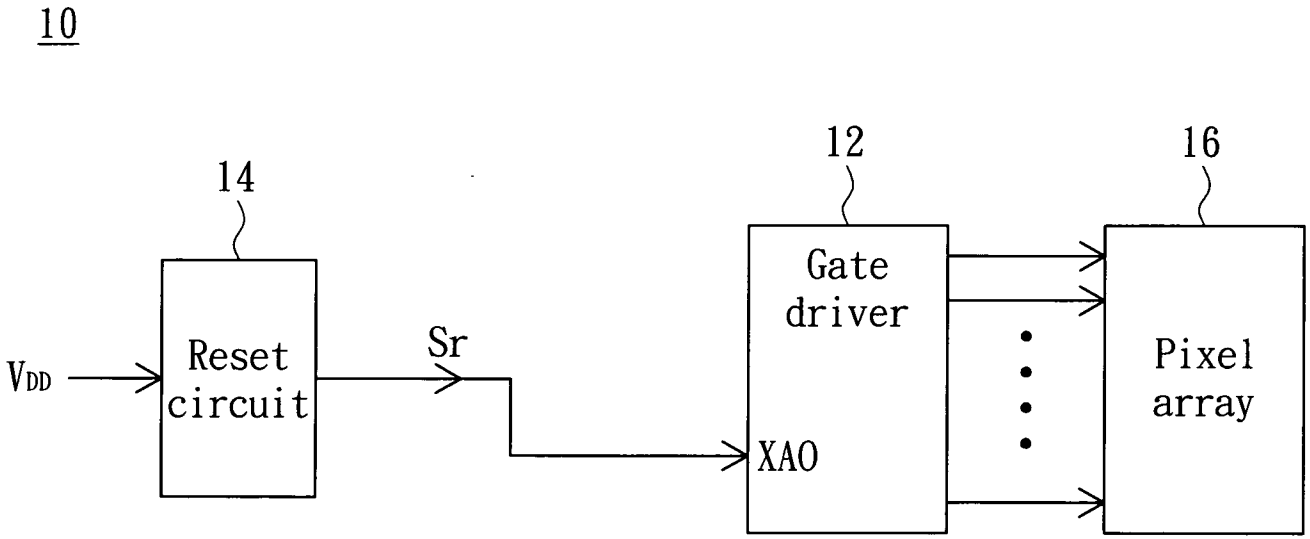
FIG. 1(PRIOR ART)
FIG. 1 (Prior Art) is a schematic illustration showing a conventional liquid crystal display.
Figure 2A:
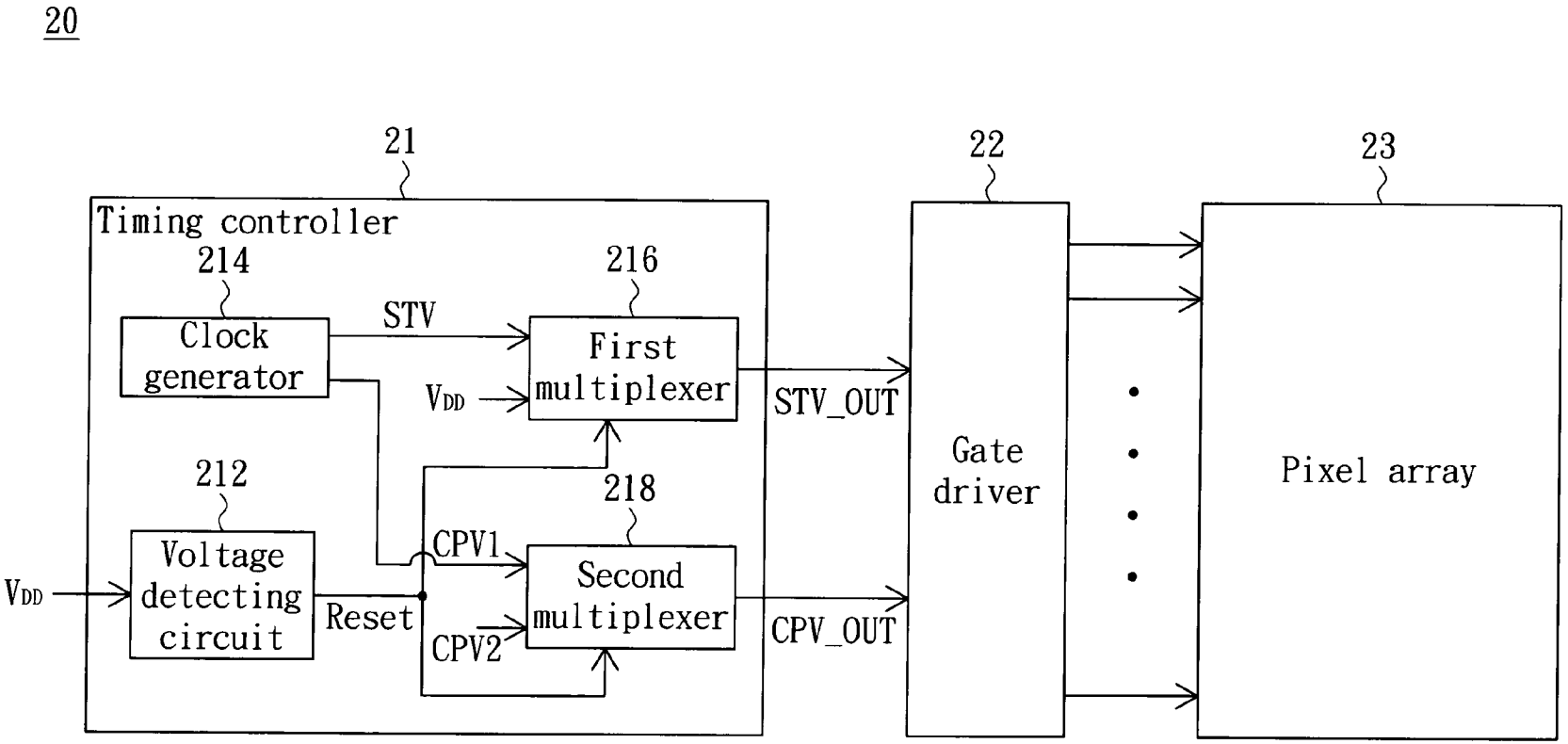
FIG. 2A is a block diagram showing a flat display according to a first embodiment of the invention.

FIG. 2A is a block diagram showing a flat display 20 according to a first embodiment of the invention. Referring to FIG. 2A, the flat display 20, such as a LCD, includes a timing controller 21, a gate driver 22, a source driver (not shown in FIG. 2A) and a pixel array 23. The timing controller 21 includes a voltage detecting circuit 212, a clock generator 214, a first multiplexer 216 and a second multiplexer 218. The voltage detecting circuit 212 detects a variation of an operating voltage VDD and thus outputs a reset signal Reset. The clock generator 214 outputs a start signal STV and a first clock signal CPV1, which are required to make the gate driver 22 operate normally. The first multiplexer 216 is controlled by the reset signal Reset to select the start signal STV or a constant voltage as an output signal STV_OUT, wherein the constant voltage and the start signal STV have opposite levels. For example, when the start signal STV for the normal operation is the low level voltage, the constant voltage may be the operating voltage VDD or any high level voltage generated by the timing controller 21 itself.

The second multiplexer 218 is controlled by the reset signal Reset to select the first clock signal CPV1 or a second clock signal CPV2 as an output signal CPV_OUT, wherein the second clock signal CPV2 has a frequency obviously higher than a frequency of the first clock signal CPV1. The second clock signal CPV2 may be generated by an oscillator in the timing controller 21. The second clock signal CPV2 may also be an oscillation clock signal provided by other circuits in the flat display 20. The gate driver 22 is coupled to the first multiplexer 216 and the second multiplexer 218, and outputs a gate signal to turn on each scan row of the pixel array 23 according to the output signals STV_OUT and CPV_OUT.

Figure 2B:
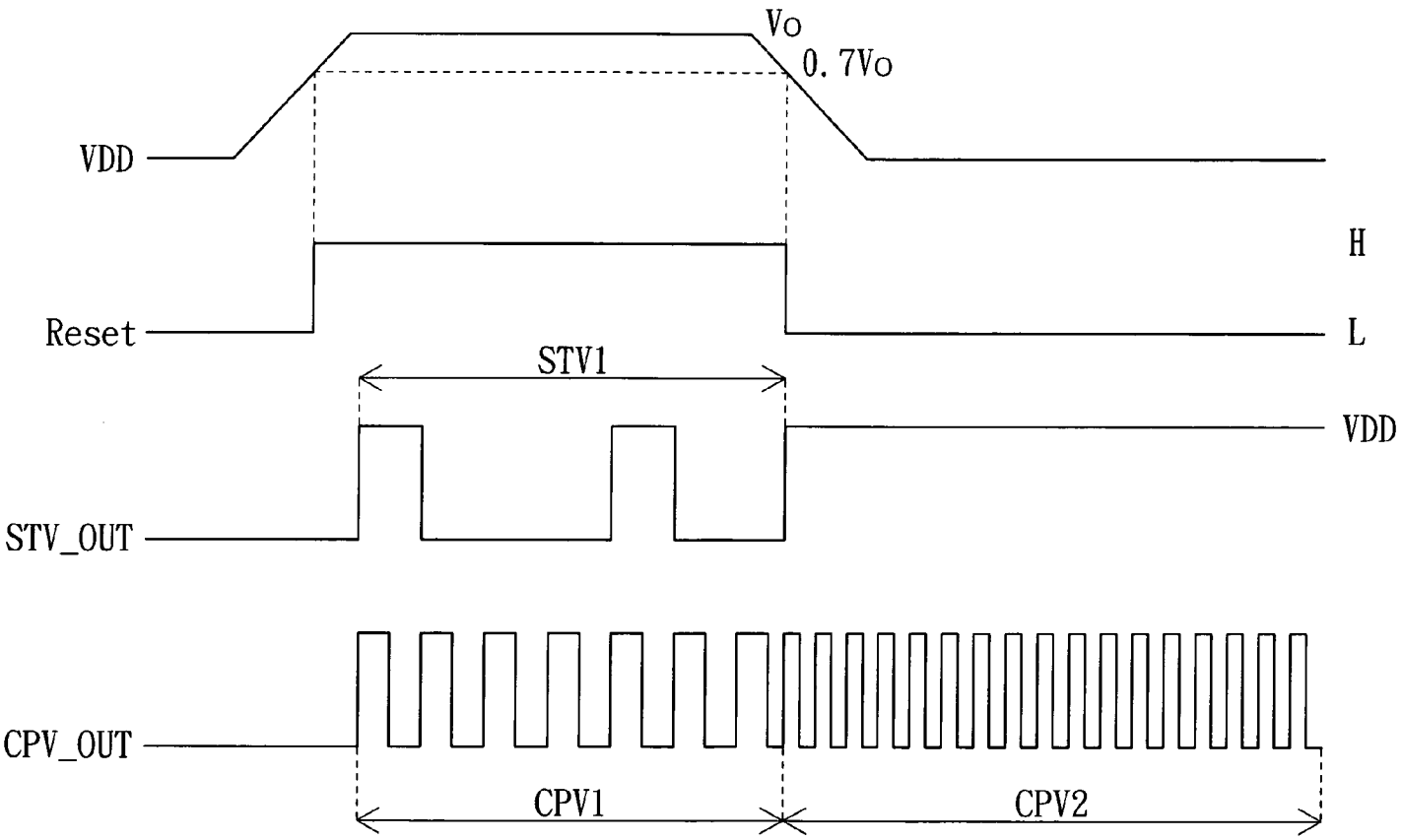
FIG. 2B is a timing chart showing timings of an operating voltage VDD, a reset signal Reset, an output start signal STV_OUT and an output clock signal CPV_OUT according to the first embodiment of the invention.

FIG. 2B is a timing chart showing timings of the operating voltage VDD, the reset signal Reset, the output start signal STV_OUT and the output clock signal CPV_OUT according to the first embodiment of the invention. When the flat display 20 operates normally, the voltage detecting circuit 212 outputs the reset signal Reset having the high level (i.e., the voltage level is H) according to the existence of the operating voltage VDD (=V0) to control the first multiplexer 216 to output the start signal STV to the gate driver 22. That is, the output signal STV_OUT outputted from the timing controller 21 is the start signal STV. Meanwhile, the voltage detecting circuit 212 outputs the reset signal Reset having the high level (i.e., the voltage level is H) to control the second multiplexer 218 to output the first clock signal CPV1 to the gate driver 22. That is, the output signal CPV_OUT outputted from the timing controller 21 is the first clock signal CPV1. At this time, the gate driver 22 outputs the gate signal to the pixel array 23 to display the image normally according to the normal start signal STV and the clock signal CPV1.

When the flat display 20 is shut down, for example, the voltage detecting circuit 212 outputs the reset signal Reset having the low level (i.e., the voltage level is L) to control the first multiplexer 216 to output the operating voltage VDD or the constant high level voltage to the gate driver 22 when the operating voltage VDD is lowered to 70% (i.e., 0.7V0). That is, the output signal STV_OUT outputted from the timing controller 21 is converted into the operating voltage VDD or the constant high level voltage. Meanwhile, the voltage detecting circuit 212 outputs the reset signal Reset having the low level (i.e., the voltage level is L) to control the second multiplexer 218 to output the second clock signal CPV2 to the gate driver 22. That is, the output signal CPV_OUT outputted from the timing controller 21 is converted into the second clock signal CPV2.

At this time, the gate driver 22 quickly outputs the gate signal having a high level voltage Vgh according to the received operating voltage VDD or the constant high level voltage and the clock signal CPV2 with the obvious higher frequency. Thus, the thin film transistors in all the scan rows of the pixel array 23 are quickly turned on so that the effect of eliminating the shutdown residual image can be achieved.

Second Embodiment

Figure 3:
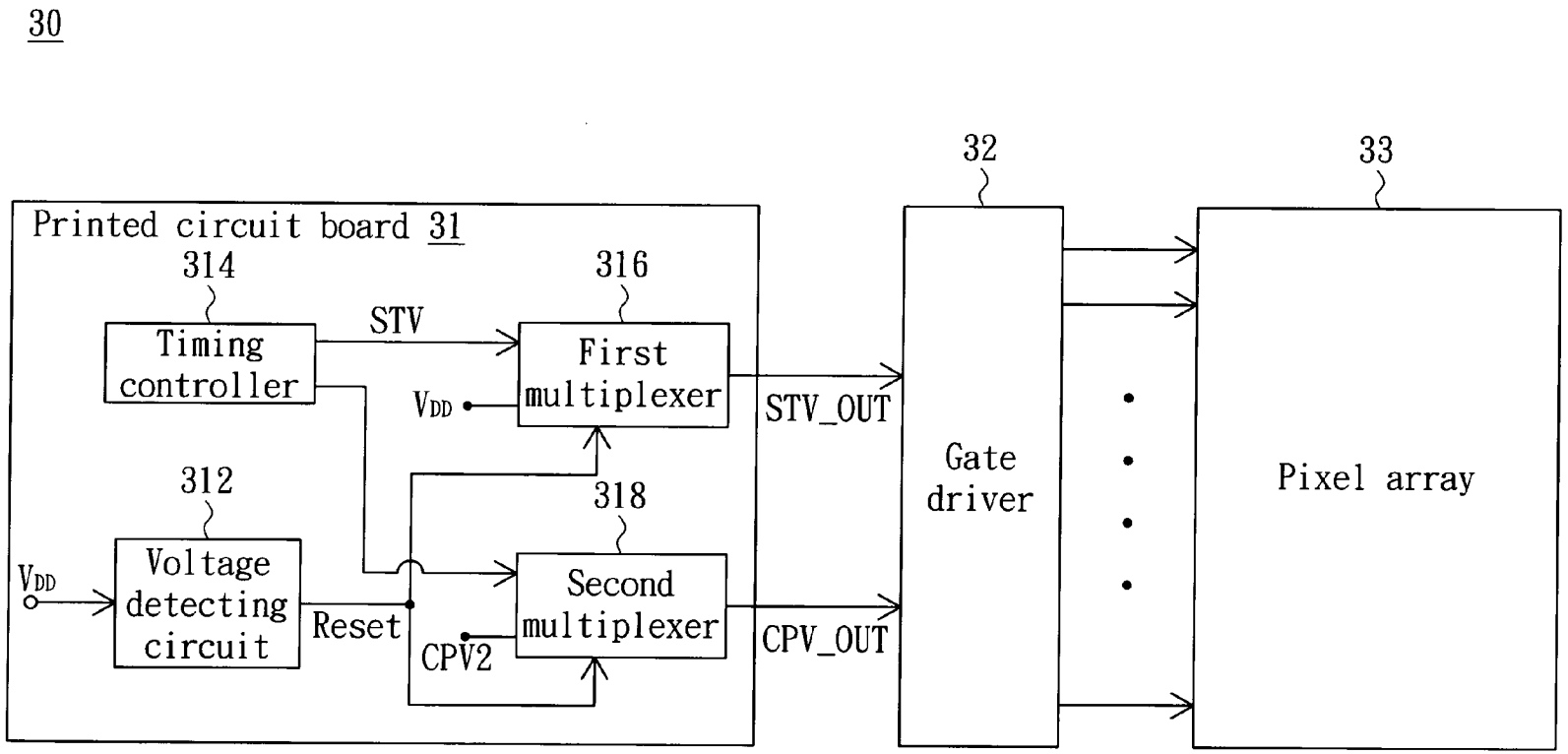
FIG. 3 is a block diagram showing a flat display according to a second embodiment of the invention.

FIG. 3 is a block diagram showing a flat display 30 according to a second embodiment of the invention. Referring to FIG. 3, the flat display 30, such as a LCD, includes a gate driver 32, a source driver (not shown in FIG. 3), a pixel array 33, a voltage detecting circuit 312, a timing controller 314, a first multiplexer 316 and a second multiplexer 318. The voltage detecting circuit 312, the timing controller 314, the first multiplexer 316 and the second multiplexer 318 may be disposed on a printed circuit board 31. The voltage detecting circuit 312 detects a variation of an operating voltage VDD and thus outputs a reset signal Reset. The timing controller 314 outputs a start signal STV and a first clock signal CPV1 for making the gate driver 32 operate normally. The first multiplexer 316 is controlled by the reset signal Reset to select the start signal STV or a constant voltage as an output signal STV_OUT, wherein the constant voltage and the start signal STV have opposite levels. For example, when the start signal STV is the low level voltage, the constant voltage is the operating voltage VDD or the high level voltage generated by other circuits on the printed circuit board 31.

The second multiplexer 318 is controlled by the reset signal Reset to select the first clock signal CPV1 or a second clock signal CPV2 as an output signal CPV_OUT, wherein the second clock signal CPV2 has a frequency obviously higher than a frequency of the first clock signal CPV1. The second clock signal CPV2 is generated by other circuits on the printed circuit board 31 or an oscillator in the timing controller 314. The gate driver 32 is coupled to the first multiplexer 316 and the second multiplexer 318, and outputs a gate signal to turn on each scan row of the pixel array 33 according to the output signals STV_OUT and CPV_OUT.

Similar to the first embodiment, as shown in FIG. 2B, when the flat display 30 operates normally, the voltage detecting circuit 312 outputs the reset signal Reset having the high level to control the first multiplexer 316 to output the start signal STV to the gate driver 32 according to the existence of the operating voltage VDD (=V0), and to control the second multiplexer 318 to output the first clock signal CPV1 to the gate driver 32 so that the gate driver 32 outputs the normal gate signal to the pixel array 33 to display the normal image. When the flat display 30 is shut down and when the operating voltage VDD is lowered to 70% (i.e., 0.7V0), the voltage detecting circuit 312 outputs the reset signal Reset having the low level to control the first multiplexer 316 to output the operating voltage VDD or the constant high level voltage to the gate driver 32, and to control the second multiplexer 318 to output the second clock signal CPV2 to the gate driver 32. Thus, the gate driver 32 outputs the gate signal having a high level voltage Vgh according to the operating voltage VDD or the constant high level voltage and the clock signal CPV2 having the obvious higher frequency. Consequently, the thin film transistors in all the scan rows of the pixel array 33 are quickly turned on so that the effect of eliminating the shutdown residual image can be achieved.

The flat display according to each embodiment of the invention eliminates the shutdown residual image according to the timing control of the circuit in the timing controller or other circuits in the flat display. Thus, the thin film transistors in all the scan rows of the pixel array can be quickly turned on and the residual image can be quickly eliminated during the shutdown without adding the reset circuit and adding the scan-row-fully-open pin XAO to the gate driver.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A timing controller adapted to a flat display, the timing controller comprising:

a voltage detecting circuit for detecting a variation of an operating voltage and thus outputting a reset signal;

a clock generator for outputting a start signal and a first clock signal;

a first multiplexer, which is controlled by the reset signal and coupled to the start signal and a constant voltage; and a second multiplexer, which is controlled by the reset signal and coupled to the first clock signal and a second clock signal, the second clock signal having a frequency higher than a frequency of the first clock signal, wherein:

when the flat display operates normally, the voltage detecting circuit outputs the reset signal having a first level voltage according to existence of the operating voltage to control the first multiplexer to output the start signal to a gate driver of the flat display, and to control the second multiplexer to output the first clock signal to the gate driver; and when the flat display is shut down, the voltage detecting circuit outputs the reset signal having a second level voltage according to the variation of the operating voltage to control the first multiplexer to output the constant voltage to the gate driver, and to control the second multiplexer to output an $i^{th}$ pulse among a plurality of pulses of the second clock signal to the gate driver to turn on a first row to an $i^{th}$ row of thin film transistors of the flat display to neutralize charges in liquid crystal capacitors connected to the turned-on first row to the turned-on $i^{th}$ row of thin film transistors by charges in others of the liquid crystal capacitors connected to the turned-on first row to the turned-on $i^{th}$ row of thin film transistors, i being a natural number, wherein the first level voltage and the second level voltage have opposite levels.

2. The timing controller according to claim 1, wherein the constant voltage and the start signal have opposite levels.

3. The timing controller according to claim 1, further comprising an oscillator for generating the second clock signal.

4. The timing controller according to claim 1, wherein the second clock signal is an oscillation clock signal provided from an oscillator of the flat display.

5. The timing controller according to claim 1, wherein when the flat display is shut down and when the operating voltage is lowered to a predetermined ratio, the voltage detecting circuit outputs the reset signal of the second level voltage to control the first multiplexer to output the constant voltage and to control the second multiplexer to output the second clock signal.

6. The timing controller according to claim 1, wherein the flat display is a liquid crystal display.

7. A flat display comprising a pixel array, a gate driver and a source driver, characterized in that the flat display further comprises:

a voltage detecting circuit for detecting a variation of an operating voltage and thus outputting a reset signal;

a timing controller for outputting a start signal and a first clock signal;

a first multiplexer, which is controlled by the reset signal and coupled to the start signal and a constant voltage; and a second multiplexer, which is controlled by the reset signal and coupled to the first clock signal and a second clock signal, the second clock signal having a frequency higher than a frequency of the first clock signal, wherein:

when the flat display operates normally, the voltage detecting circuit outputs the reset signal having a first level voltage according to existence of the operating voltage to control the first multiplexer to output the start signal to the gate driver, and to control the second multiplexer to output the first clock signal to the gate driver; and when the flat display is shut down, the voltage detecting circuit outputs the reset signal having a second level voltage according to the variation of the operating voltage to control the first multiplexer to output the constant voltage to the gate driver, and to control the second multiplexer to output an $i^{th}$ pulse among a plurality of pulse of the second clock signal to the gate driver to turn on a first row to an $i^{th}$ row of thin film transistors of the pixel array of the flat display to neutralize charges in liquid crystal capacitors connected to the turned-on first row to the turned-on $i^{th}$ row of thin film transistors by charges in others of the liquid crystal capacitors connected to the turned-on first row to the turned-on $i^{th}$ row of thin film transistors, i being a natural number, wherein the first level voltage and the second level voltage have opposite levels.

8. The flat display according to claim 7, wherein the constant voltage and the start signal have opposite levels.

9. The flat display according to claim 7, wherein the timing controller further comprises an oscillator for generating the second clock signal.

10. The flat display according to claim 7, wherein the second clock signal is generated by an oscillator of the flat display.

11. The flat display according to claim 7, wherein when the flat display is shut down and when the operating voltage is lowered to a predetermined ratio, the voltage detecting circuit outputs the reset signal having the second level voltage to control the first multiplexer to output the constant voltage and to control the second multiplexer to output the second clock signal.

12. The flat display according to claim 7 being a liquid crystal display.

13. The flat display according to claim 7, wherein the voltage detecting circuit, the timing controller, the first multiplexer and the second multiplexer are integrated in a single integrated circuit.

14. The flat display according to claim 7, wherein the voltage detecting circuit, the timing controller, the first multiplexer and the second multiplexer are separately formed on a printed circuit board.

* * * * *